United States Patent [19]

Devalois et al.

[11] Patent Number: 4,460,409

[45] Date of Patent: Jul. 17, 1984

[54] PROCESS AND INSTALLATION FOR PROTECTING A JET OF MOLTEN METAL FOR CASTING

[75] Inventors: Serge Devalois, Fourqueux; Thierry Hersant, Chatou; Albert G. Goursat, Elancourt Maurepas; François Weisang, Antony, all of France

[73] Assignee: L'Air Liquide, Societe Anonyme pour l'Etude et l'Exploitation des Procedes Georges Claude, Paris, France

[21] Appl. No.: 474,543

[22] Filed: Mar. 11, 1983

[30] Foreign Application Priority Data

Mar. 15, 1982 [FR] France ..... 82 04297

[51] Int. Cl.[3] ..... C22B 9/00; C21C 7/10

[52] U.S. Cl. ..... 75/96; 266/207

[58] Field of Search ..... 75/96; 266/207

[56] References Cited

U.S. PATENT DOCUMENTS

| | | | |
|---|---|---|---|
| 2,811,346 | 10/1957 | Spire | 266/220 |
| 3,963,224 | 6/1976 | Pollard | 266/207 |
| 4,093,553 | 6/1978 | Galey | 75/96 |
| 4,178,980 | 12/1979 | Gilbert | 75/96 |
| 4,181,522 | 1/1980 | Galey | 75/96 |
| 4,313,596 | 2/1982 | King | 266/207 |

*Primary Examiner*—Peter D. Rosenberg

*Attorney, Agent, or Firm*—Lee C. Robinson, Jr.

[57] ABSTRACT

The invention relates to the protection of a casting jet of molten metal, flowing between an upper storage tank and a lower receiving vessel. At least one inert liquefied gas is injected above and close to the surface of the molten metal contained in the lower vessel, and, at the same time, at least one inert gas is injected into the molten metal through the base or the walls of the lower vessel. The process of this invention protects metal casting jets from oxidation, for example, jets between ladle and manifold, between ladle and ingot mold, between ladle and ladle, or between converter (or furnace) and ladle.

17 Claims, 9 Drawing Figures

PROCESS AND INSTALLATION FOR PROTECTING A JET OF MOLTEN METAL FOR CASTING

FIELD OF THE INVENTION

The invention concerns the protection of a jet of molten metal running between an upper storage tank and a lower vessel.

BACKGROUND OF THE INVENTION

Some processes used up to the present time to protect a jet of molten metal in casting consisted of releasing a liquified inert gas at the upper part of said jet. For instance, U.S. Pat. No. 4,178,980 describes a process whereby the inert liquefied gas is supplied by a generally ring-shaped device positioned around the upper tank. This system is not always satisfactory; this is because the creation of an inert atmosphere over the whole part of the jet can sometimes take a certain amount of time; the air is then carried along by the moving metal, particularly at the point of impact of the jet with the metal bath; this air, which is dragged into the bath, reacts with the metal, thereby causing nitrogen to dissolve and the formation of oxide inclusions.

To overcome these disadvantages, the applicant has recently developed a process, whereby a rising protective gas sheath is created around the casting jet over the whole height of this jet, and formed from at least one gas which is virtually inert with respect to the metal. More precisely, this rising protective sheath is formed by injecting the inert gas around the impact zone of said jet and by confinement of said inert gas above the surface of the molten metal and around the base of said jet by means of a sleeve, open at both ends, running around the base of said jet and partially immersed in the molten liquid.

In this way, the protective gas confined around the jet and raised to a high temperature is subjected to an upwards force which enables a protective gaseous sheath to be formed along the jet of metal, and running in an opposite direction to this, thereby preventing any drag effect on the air by the running molten metal.

SUMMARY AND OBJECTS OF THE INVENTION

The object of this invention is a new process to create a rising protective sheath of this type.

The process, in accordance with the invention, is characterized in that at least one inert liquefied gas is injected above and close to the surface of the molten metal contained in the lower vessel and, simultaneously, an inert gas is injected into the molten metal through the base or the walls of said vessel.

According to the invention, the injection of an inert liquefied gas above and close to the surface of the molten metal is performed by injecting said gas inside the sleeve and slightly below the upper opening of said sleeve. The protective layer of liquefied gas formed in this way on the surface of the molten metal vaporizes and produces a gaseous atmosphere inside the sleeve which escapes by the upper opening of the latter and prevents any of the air from being drawn along the casting jet. The simultaneous injection, in accordance with the invention, of an inert gas into the molten metal through the base or the walls of the vessel, below the impact zone of the jet, also helps in forming this protective rising gaseous sheath. In addition, injection of the inert gas into the molten metal brings about a mixing of said metal which hinders unwanted solidifications, improves coalescence of inclusions and thus facilitates the subsequent decantation of the latter, and provides a purging effect, i.e. desorption of any gas dissolved in the bath; this avoids formation of a crust which, without the metal bath being mixed, would form after a certain period of time.

The inert liquefied gas and the inert gas injected into the molten metal are either of the same type, or of different types.

For the rising gaseous atmosphere to be considered to be inert with respect to the metal, it must contain less than 5% oxygen. A representative value of this oxygen content is the ratio $V_2/T_2$ ($V_2$ and $T_2$ being the speed and temperature at which the rising gaseous atmosphere formed reaches the upper opening of the sleeve); it is possible to associate with these characteristics of the rising gaseous flow, a reversed diffusion of the air due to the fact that said flow stops the air entering into the sleeve, and thus reduces the oxygen content of said gaseous flow.

For this reason, according to the invention, the injection flow $D_1$ of the inert liquefied gas is adjusted so that the value of $V_2/T_2$ corresponds to an oxygen content in said atmosphere of less than 5%, in accordance with the equation:

$$\frac{V_2}{T_2} + \frac{1}{60.10^3} \cdot \frac{1}{T_1} \cdot \frac{S_1}{S_2} \cdot \frac{\rho_L}{\rho_G} \cdot D_1, \qquad (1)$$

in which:

$T_1$ is the boiling point of the inert liquefied gas, expressed in degrees K.;

$S_1$ and $S_2$ are the cross sections of the lower and upper openings of the sleeve;

$\rho_L$ and $\rho_G$ are the densities of the inert gas in the liquid state and in the gaseous state;

$V_2$ is expressed in m/s, $T_2$ in degrees K. and $D_1$ in liter/min/m$^2$. In addition, the injection flow $D_2$ of the inert gas into the molten metal is adjusted so that the value of $V_2/T_2$ corresponds to an oxygen content in said atmosphere of less than 5%, in accordance with the equation:

$$\frac{V_2}{T_2} = \frac{1}{3600} \cdot \frac{1}{T_1} \cdot \frac{S_1}{S_2} \cdot \frac{\rho_L}{\rho_G} \cdot \frac{T}{410} \cdot D_2, \qquad (2)$$

where $V_2$, $T_2$, $T_1$, $S_1$, $S_2$, $\rho_L$, $\rho_G$ are the same parameters as those in equation (1) above, T is the temperature of the molten metal expressed in degrees K. and $D_2$ is expressed in m$^3$/hour.

For instance, if the inert gas used is nitrogen, the value of $V_2/T_2 > 3.5 \cdot 10^{-4}$ meters per second/°K. necessary for the oxygen content of the atmosphere to be less than 5% is determined experimentally; in addition, taking account of the parameters for nitrogen ($T_1$, $\rho_L$, $\rho_G$) and the dimensions of the sleeve used (cross sections $S_1$ and $S_2$), the flow of injected nitrogen is adjusted in accordance with equation(s) (1) and/or (2). If the inert gas used is argon, the value of $V_2/T_2$ is determined experimentally and it must be greater than $1.7 \cdot 10^{-4}$ m/s/°K. and the flow of injected argon is adjusted in accordance with equation(s) (1) and/or (2).

Another aim of the specifications of the invention is to supplement the protection of the molten metal jet immediately as it leaves the base of the upper storage tank, by creating a gaseous protective atmosphere formed from at least one gas that is virtually inert with respect to said metal, said atmosphere enveloping a control head device mounted externally onto the base of said upper tank, comprising a fixed plate and moving assembly consisting of a moving plate pressed against said fixed plate and a metal bracket integral with said moving plate for at least one small nozzle which can communicate with the molten metal discharge hole. More precisely, the inert gaseous atmosphere formed more specifically counteracts any infiltration of air in the gap between the fixed plate and the moving plate as well as in the junction zone between the moving plate and nozzle(s) and also protects the jet of molten metal just as it comes out of one of the nozzles.

This protection of the molten metal jet immediately as it leaves the upper tank, is a worthwhile adjunct to the protection of said jet over its whole height by means of the rising gas sheath, because the molten metal jet can thus only draw with it, as it runs down, the inert gas in the sleeve encircling its base.

Another object of the invention is also a transfer installation for a molten metal using the process in question and comprising an upper tank and a lower vessel fitted with an internal refractory lining and a sleeve in refractory material, open at its two ends, the upper opening of said sleeve being situated below the discharge orifice of the upper tank, and the lower end of said sleeve being located at some distance from the base of the lower vessel, while the upper end of said sleeve substantially protrudes above the rim of said lower vessel. This installation comprises means for injecting an inert liquefied gas inside said sleeve and slightly below the upper opening of said sleeve and means for injecting at least one inert gas through the base or the walls of the lower vessel.

The characteristics and advantages of the invention can be better understood by reading the following description by referring to the appended drawings.

BRIEF DESCRIPTION OF THE DRAWINGS

FIG. 1 is a partial diagrammatic section of an initial variation of one first embodiment of an installation in accordance with the invention;

FIG. 2 is a partial section along line II—II in FIG. 1, viewed along arrow X;

FIG. 3 is a partial section in the same plane as FIG. 2, representing a second variation of the first embodiment of an installation in accordance with the invention;

FIG. 4 is a partial section in the same plane as FIG. 2, representing a second embodiment of an installation in accordance with the invention, the right half representing an initial variation and the left half representing a second variation of said second embodiment of;

FIG. 5 is a partial section in the same plane as FIG. 4, but is an extract, representing a third variation on the second embodiment of an installation in accordance with the invention;

FIGS. 6, 7, 8 and 9 are diagrammatic representations, partially as sections of four embodiments of the protective device for the casting jet as it leaves the upper storage tank.

DESCRIPTION OF THE PREFERRED EMBODIMENTS

In accordance with the method of construction represented in FIGS. 1 and 2, an upper storage tank (1) contains the molten metal which, after running through a plate-type control device (2) mounted on the outside of the base of the tank (1), runs in the form of a jet J and reaches a lower vessel (3). The walls and the base of this vessel (3) are formed of an external shell (4), an intermediate sand lining (5) and an internal refractory lining (6). A sleeve (7) made of refractory material, open at both ends and partially immersed in bath (8) of molten metal contained in vessel (3), is arranged around jet J. This sleeve consists of two parts (9) and (10); the upper part (9) substantially protrudes above the sides of vessel (3); it is in the shape of a truncated pyramid comprising four walls (9*a*, 9*b*, 9*c*, 9*d*); two opposite walls (9*a* and 9*b*) of this upper part (9) rest on two opposed upper edges of vessel (3). The lower part (10) consists of two vertical plates (10*a*, 10*b*) in line with parts (9*d* and 9*c*) of part (9), immersed in the bath of molten metal (8). The sleeve is arranged so that its axis coincides substantially with jet J. The lower opening of sleeve (7) has a cross section $S_1$ and the upper opening a cross section $S_2$.

A tank of inert liquefied gas (11) is connected by a pipe (12) fitted with a valve (13) to a phase separator (14) which, via a flow adjustment valve (15) feeds the injection tube (16) having a calibrated orifice (17) with liquefied gas; this injection tube (16) extends slightly below the lower opening of sleeve (7).

In the part of the internal refractory lining (6) of the vessel base (3), which is below sleeve (7), are two porous sections (21). These porous sections (21) are connected by tubes (22) located within the intermediary sand lining (5) and connected to a distributor (23) itself connected to a source (24) of pressurized inert gas.

The installation represented in FIGS. 1 and 2 operates in the following manner. The inert liquefied gas coming from tank (11) is injected into the upper part (9) of sleeve (7) by means of the injection tube (16) which pours this inert liquefied gas directly onto the surface of the molten metal bath (8) contained in vessel (3). The inert liquefied gas poured in in this way is heated to form a liquid layer on the part of the bath's surface (8) which is between plates (10*a*) and (10*b*), and vaporizes, creating a rising gas sheath which, initially, flushes out the air which was contained in sleeve (7) and then discourages any possible entry of air brought in by the casting jet J. Because of the restricting shape towards the upper part (9) of sleeve (7), this rising protective sleeve flows along arrows F, in the direction of the casting jet J. Simultaneously, the inert gas coming from source (24) is injected into the molten metal bath (8) around the zone of impact of jet J, by means of the porous sections (21). The gas escapes as bubbles which burst at the surface of bath (8) and form a column of rising gas which, channeled by sleeve (7), flows in the direction of arrows F. In addition, injection of inert gas into the bath of metal (8) brings about mixing of said bath and makes it possible to avoid the formation of a crust on the surface of bath (8) as was explained previously. The flows of the inert gas injected in the molten metal are adjusted as has been explained above, so that the speed/temperature ratio of the atmosphere formed in the sleeve corresponds to an oxygen content in this atmosphere of less than 5%.

According to a variation of the construction represented in FIG. 3, metal pipes (25) are incorporated into the internal refractory lining (6) at the bottom of the receiving vessel (3). These pipes (25) are connected (in the same way as the porous sections (21) in FIGS. 1 and 2) to a source of inert gas under pressure (24) via pipework (22). All parts of this installation (with the exception of pipes (25) which replace the porous sections (21)) are identical and have the same reference numbers as those on the installation shown in FIGS. 1 and 2; their functioning is also the same.

According to the method of construction shown in FIG. 4, an upper storage tank (41) contains a molten metal which, after travelling through a plate control head (42), runs out in the form of a jet J into a lower vessel (43). The walls and base of this vessel (43) are formed by an external casing (44), an intermediary sand lining (45) and an internal refractory lining (46). A sleeve (47), open at both ends and partially immersed in the bath (48) of molten liquid contained in vessel (43), is positioned around the jet J. This sleeve (47) comprises two parts (49) and (50); the upper part (49) is in the form of a truncated pyramid comprising four walls (49*a*, 49*b*, 49*c*, 49*d*; 49*c* and 49*d* not being shown in this sectional view); two opposite walls (49*a* and 49*b*) of this part (49) bear onto the two opposite sides of the vessel (43). The lower part (50) consists of two vertical plates (50*a*) and (50*b*) in line with parts (49*c*) and (49*d*) of part (49), immersed in the molten metal bath (48). Sleeve (47) is arranged in such a way that its axis coincides substantially with jet J.

According to the first construction variation represented on the right-hand side of FIG. 4, metal pipes (51) pass through the internal refractory lining (46) of the walls of vessel (43); these pipes (51) are connected, by means of pipings (52) located in the intermediate sand lining (45) to a distributor (53), itself connected to a source (54) of pressurized inert gas. The pipes (51) which have a diameter of 1 to 4 mm and preferably 2 mm, are positioned so as to come out at a distance of about 25 to 30 cm below the surface of the molten metal bath (48).

According to the second construction variation represented on the left-hand side of FIG. 4, the porous sections (55) are incorporated in the internal refractory lining (46) of the walls of the vessel (43); these porous sections (55) are connected by pipings (52') to a distributor (53') itself connected to a source of inert gas under pressure (items 52' and 53' are identical to items 52 and 53).

According to the third construction variation shown in FIG. 5, ducts (56) are arranged longitudinally in the refractory lining (46) of the walls of vessel (43). These ducts (56) are connected, at their upper part, via pipings (57) to a distributor (58), itself connected to a source of inert gas under pressure (not shown on the figure). Ducts (56) communicate at their lower section with ducts (59) which are provided transversely in the refractory lining (46) and which end in the molten metal bath contained in vessel (43).

The installation represented in FIGS. 4 and 5 operates as follows. An inert gas is injected into the molten metal bath (48) either via the pipes (51) or the porous sections (55), or the ducts (56, 59), in accordance with one of the three methods of construction described above. At the same time, an inert liquefied gas is injected in the upper part (49) of the sleeve (47). In this way, an inert rising gas sheath is obtained at the same time as mixing of the metal bath.

The following is a non-exhaustive list of two examples of utilization of the process in accordance with the invention using one of the installations represented in FIGS. 1 to 5.

EXAMPLE 1

The inert gas used is argon.

It is desired that the atmosphere formed in the sleeve shall have an oxygen content of less than 1%. The corresponding value of $V_2/T_2$ is determined experimentally, i.e. $V_2/T_2 > 4 \cdot 10^{-4}$ m/s/°K.

The parameters for argon are as follows:

$T_1 = 87°$ K.

$P_L = 1400$ kg/m$^3$ $P_G = 5.85$ kg/m$^3$.

The sleeve used has dimensions such that $S_1/S_2 = 1.8$.

According to equation (1), $$\left(4 \cdot 10^{-4} = \frac{1}{60.10^3} \cdot \frac{1}{87} \cdot 1.8 \cdot \frac{1400}{5.85} \cdot D\right),$$

if only liquefied argon was injected, it should be injected at a rate $>4.73$ l/mn/m$^2$.

However, simultaneously, gaseous argon is injected into the molten metal bath at a rate of 20 m$^3$/h. This quantity of gaseous argon is, according to equation (2), equivalent from the point of view efficiency of rendering inert, to 0.41 liters/mn of liquid argon. Thus, gaseous argon at a rate of 20 m$^3$/h is injected into the metal liquid simultaneously with liquefied argon at the entrance to the sleeve at a throughput of 4.32 l/mn/m$^2$.

EXAMPLE 2

The inert liquid gas used is nitrogen and the inert gas injected into the molten metal is argon.

It is desired that the atmosphere formed in the sleeve shall have an oxygen content of less than 1%. The corresponding value of $V_2/T_2$ is determined experimentally, i.e. $V_2/T_2 > 10.5 \cdot 10^{-4}$ m/s/k.

The parameters for nitrogen are as follows:

$T_1 = 77°$ K.

$\rho_L = 808$ kg/m$^3$ $\rho_G = 4.6$ kg/m$^3$

The sleeve used has dimensions such that $S_1/S_2 = 1.8$.

According to equation (1)

$$\left(10.5 \cdot 10^{-4} = \frac{1}{60.10^3} \cdot \frac{1}{77} \cdot 1.8 \cdot \frac{808}{4.6} \cdot D\right),$$

if only liquefied nitrogen was injected, it should be injected at a rate $\geqq 15$ l/mn/m$^2$.

However, gaseous argon is injected simultaneously into the molten metal at a rate of 20 m$^3$/h, which is, on the basis of equation (2), equivalent to 0.41 l/mn of liquefied argon. Gaseous argon is thus being injected at a rate of 20 m$^3$/h into the metal liquid, simultaneously with liquefied nitrogen at the entrance to the sleeve at a rate of 13.7 l/mn/m$^2$.

FIG. 6 presents the plate control head (2) (or 42) mounted outside the bottom of the upper storage tank (1) (or 41). This plate-type control head device is of a known type, described in commonly assigned U.S. patent application No. 294,323, filed Aug. 19, 1981. It comprises a fixed plate (60) and a moving plate (61), pressing one against the other, the moving plate (61) being mounted in a rotating manner and comprising two small nozzles (62); plates (60) and (61) and the nozzles (62) are made of refractory material, for instance impregnated alumina. The moving plate (61) is fitted with a toothed wheel (36), which can be driven by a pinion (7) connected to a motor (not shown on the Figure). Plate (60) has an orifice (63) in it, which is in alignment with the casting hole (64) made in the internal refractory coating (65) and the external metal casing (66), which make up the base of the tank (1). The moving plate has two channels (67) in it. Each nozzle (62) has a channel (68) in it and is mounted as required (for instance by a bayonet system) on the moving plate (61) via a metal bracket (69) so that its channel (68) shall be in alignment with the corresponding passage (67). By rotating plate (61), one or other of the small nozzles (62) is brought into line with the casting hole (64).

A metal box (70) is mounted so that it is sealed to the base of the storage tank (1) and virtually completely contains the control head device (2); an opening (71) is provided in the bottom part of the box (70) for the nozzles to pass through. A duct (72) connected to a source of inert gas under pressure (not shown on the Figure), connects with the box (70).

The inert gas introduced via duct (72) spreads inside box (70) and escapes by opening (71); This inert gas thus forms an atmosphere which protects the device (2) against atmospheric air, and more particularly, the space between plate (60) and (61) and the junction zone between the nozzles (62) and plate (61), as well as the jet of molten metal as it leaves one of the nozzles (62).

FIG. 7 represents a plate-type control head device (2) identical to that in FIG. 6 (the same reference numbers are assigned to the same components) but in addition comprises a spring-device (73) to maintain plates (60) and (61) pressed against each other. A box (70) identical with that in FIG. 6, contains the device (2). The spring system (73) comprises an end-stop (74) in the form of an inverse cup open at its bottom end and integral with plate (61) via metal bracket (69), a bearing component (75) in the form of a piston integral with plate (60) and a spring (76) located between the stop (74) and the part (75). A duct (77), connected to a source of inert gas under pressure (not shown on the Figure), ends at stop (74) after passing through box (70) by means of an orifice (78), provided for this purpose. In this way, the inert gas brought by duct (77) cools the spring system (73), and then disperses in box (70), exerting its influence in protecting device (2), and then escapes via opening (71).

FIG. 8 shows a plate control head device (2) identical to that in FIG. 6 (the same reference numbers are assigned to the same component), but in addition comprising two spring systems (80) to maintain plates (60) and (61) pressed against each other. The spring systems (80) comprise a stop (81) in the form of an inversed cup opened at its lower end and integral with plate (61) via a metal bracket (69), a thrust piece (82) in the form of a piston integral with plate (60) and a spring (83) located between stop (81) and part (82). A duct (84) connected to a source of compressed air gives onto the stop (81).

A metal ferrule (85) is positioned concentrically with the moving plate (61); at its upper section (86), it is integral with the fixed plate (60) and its lower end (87) stops close to the upper part (88) of the spring system. A duct (89), connected to a source of inert gas under pressure, leads to the ferrule (85). The ferrule (85) comprises an opening (not shown on the Figure) to allow the passage of the motor pinion (not shown on the Figure) for the moving plate (61).

A metal protection plate (90), provided with openings (91) is fixed to the bracket (69) e.g. by keying, at a distance below said bracket (69). A duct (92), connected to a source of inert gas under pressure (not represented on the Figure), is fixed to bracket (69), (e.g. by welding) and gives into the space defined by moving plate (61) and the protection plate (90).

The installation shown in FIG. 8 operates as follows: an inert gas is injected via duct (89) to the inside of ferrule (85); this inert gas spreads into the space contained by the ferrule (85) and thus protects the gap between plates (60) and (61) as well as the junctions between the small nozzles (62) and plate (61); it then runs out via openings (91). At the same time, an inert gas is injected via ducts (92); this inert gas spreads through the space enclosed between the metal bracket (69) and the protecting plate (90) and then runs out via openings (91), thus protecting the molten metal jet as it leaves the nozzles (62). In addition, the spring system is cooled by injecting compressed air via ducts (84).

FIG. 9 represents a plate-type control head device (2) comprising two spring systems (80) identical with that in FIG. 8 (same references have been assigned to the same parts). A metal ferrule (95), concentric with the moving plate (61) is integral, at its upper end (96), with the fixed plate (60). Its lower end (97) stops near the lower part (88) of the spring system (80). Ferrule (95) comprises an opening (not represented on the Figure) for the passage of the motor pinion (not represented on the Figure) for the moving plate (61).

A metal protection plate (98) provided with openings (99) is fixed to bracket (69) (e.g. by keying), at a distance from and below said bracket (69). A first duct (100), connected to a source of inert gas under pressure (not shown in the Figure), is fixed to bracket (69) (e.g. by welding) and gives into the space defined by the moving plate (61) and the protection plate (98). A second duct (101) connected to a source of inert gas under pressure (not shown on the Figure) runs through plate (98) via an orifice (102) provided for this purpose, then bracket (69) via an orifice (103), and ends in the gap (104) between the bracket (69) and the moving plate (61). This duct (101) is flexible up to a certain extent so as not to interfere with the movement of the moving system.

The installation depicted in FIG. 9 operates as follows: an inert gas is injected via duct (101) into gap (104); this inert gas spreads within the gap (104) and then into the space defined by the ferrule (95) and thus protects the junctions between the nozzles (62) and the plate (61) as well as the gap between plates (60) and (61); it then runs out via openings (99). At this same time, an inert gas is injected by duct (100); this inert gas spreads into the space contained between the metal bracket (69) and the protection plate (98), and then runs out via openings (99) thus protecting the molten metal jet as it comes out of the nozzle (62). In addition, the spring systems (80) are cooled by injected compressed air via ducts (84).

In all the methods of constructing the invention, a gas is used which is either virtually inert with respect to the molten metal such as nitrogen or argon, or a mixture of inert gases is used.

The invention applies to the protection of all metal casting jets, whether vertical or parabolic, and in particular between ladle and manifold, between ladle and ingot mold, between ladle and ladle, between converter (or furnace) and ladle.

We claim:

1. In a process for protecting a jet of molten liquid metal running between an upper storage tank and an impact zone in a lower receiving vessel such that, around said jet and extending the whole height thereof, a protective rising gas sheath is created, formed from at least one gas that is virtually inert with respect to said metal, including injecting said inert gas around the impact zone of said jet, and confining said inert gas above the surface of the molten metal and around the base of said jet by means of a sleeve, open at both ends, to enclose the base of said jet and with the sleeve being partially immersed in said molten metal; the improvement comprising injecting at least one inert gas above and near the surface of the molten metal contained in the lower vessel and, at the same time, injecting at least one inert gas into the molten liquid metal through one or both of the base and the walls of said vessel.

2. Process according to claim 1, wherein inert liquefied gas is injected within the sleeve and slightly below the upper opening of said sleeve, and the inert gas is injected into the molten metal through the base or walls of said vessel, at a rate such that the rising gas atmosphere thus formed has an oxygen content of less than 5% within said sleeve.

3. Process according to claim 1, wherein the inert gas, having a boiling point of $T_1$ and densities $\rho_L$ in the liquid state and $\rho_G$ in the gaseous state, the confinement sleeve having a lower opening of cross-section $S_1$ and an upper opening of cross-section $S_2$, and the rising gas atmosphere reaching said upper opening at velocity $V_2$ and temperture $T_2$, the value of $V_2/T_2$ being representative of the oxygen content of said rising gas atmosphere, and being linked to the flow D of the inert liquefied gas injected inside the sleeve by the relationship:

$$\frac{V_2}{T_2} = \frac{1}{60.10^3} \cdot \frac{1}{T_1} \cdot \frac{S_1}{S_2} \cdot \frac{\rho_L}{\rho_G} \cdot D,$$

further comprising adjusting said flow D so that said value $V_2/T_2$ corresponds to an oxygen content of said atmosphere of less than 5%.

4. Process according to claim 1, the inert gas, having a boiling point $T_1$ and densities $\rho_L$ in the liquid state and $\rho_G$ in the gaseous state, the confinement sleeve having a lower opening of cross-section $S_1$ and an upper opening of cross-section $S_2$, the temperature of the molten metal being T, and the rising gas atmosphere reaching said upper opening at velocity $V_2$ and temperature $T_2$, the value of $V_2/T_2$ being representative of the oxygen content of said gas atmosphere, and being linked to the flow D of the inert gas injected into the molten metal by the relationship:

$$\frac{V_2}{T_2} = \frac{1}{3600} \cdot \frac{1}{T_1} \cdot \frac{S_1}{S_2} \cdot \frac{\rho_L}{\rho_G} \cdot \frac{T}{410} \cdot D,$$

further comprising adjusting said flow D so that the said value $V_2/T_2$ corresponds to an oxygen content in said atmosphere of less than 5%.

5. Process according to one of claims 3 or 4, wherein the inert gas used is nitrogen, and wherein the flows of said gas are adjusted so that $(V_2/T_2) > 3.5 \cdot 10^{-4}$ m/s/°K.

6. Process according to one of claims 3 or 4, wherein the inert gas used is argon, and that the flows of said gas are adjusted so that $(V_2/T_2) > 1.7 \cdot 10^{-4}$ m/s/°K.

7. Process according to one of claims 1 to 4, wherein a protective gaseous atmosphere is created for the molten metal jet immediately as it leaves the base of the upper tank, said atmosphere being formed from at least one gas that is virtually inert with respect to said metal, by means of a surrounding control head device mounted outside the base of said upper tank, comprising a fixed plate and a moving system consisting of a moving plate pressing against said fixed plate and a metal bracket integral with said moving plate so that at least one nozzle can communicate with the molten metal flow hole.

8. Transfer installation for a molten metal using the process according to claim 1, comprising an upper storage tank (1), a lower vessel (3), fitted with an internal refractory lining, and a sleeve (7) made of refractory material, open at both ends, the upper end of said sleeve (7) being located below the outlet of the upper tank (1), the lower end of said sleeve (7) being located at a distance from the bottom of the lower vessel (3), whereas the upper end of said sleeve (7) substantially protrudes above the top of said lower vessel (3), wherein it comprises means for injecting an inert liquefied gas within said sleeve and slightly below the upper opening of said sleeve and means for injecting at least one inert gas through one or both of the base and walls of the lower vessel.

9. Installation according to claim 8, wherein the means for injecting an inert liquefied gas include at least one injection tube (16) fitted with a calibrated orifice (17) ending slightly below the upper opening of said sleeve (7) and connected, via flow control units, to a source of liquefied gas (11).

10. Installation according to claim 8 wherein the means for injecting an inert gas through the base or walls of the lower vessel include metal pipings (25) passing through the refractory lining (6) of said vessel and connected to a source of inert gas under pressure (24).

11. Installation according to claim 8 wherein the means for injecting an inert gas through the base or walls of the lower vessel include porous or permeable sections (21) built into the refractory lining (6) of said vessel and linked to a source of inert gas under pressure (24).

12. Installation according to claim 8 wherein the means for injecting an inert gas through the walls of the lower vessel include ducts (56, 59) provided in the refractory lining (46) of said vessel and connected to a source of inert gas under pressure.

13. Installation according to one of claims 8 to 12, further comprising means for creating a protective gaseous atmosphere formed from at least one inert gas for a control head device (2) mounted on the outside of a base of the upper tank (1), the control head device comprising a fixed plate (60) and a moving system comprising a moving plate (61) pressing against said fixed plate and a metal bracket (69) integral with said moving plate (61), so that at least one nozzle (62) can communicate with a molten metal flow hole in the base of said upper tank (1).

14. Installation according to claim 13, further comprising a metal box (70) fixed in a sealed manner onto the base of the upper tank (1), enclosing the control head device (2) provided with at least one opening (71) comprising an inert gas input duct (72).

15. Installation according to claim 14, in which the control head device (2) comprises at least one spring system (73) for maintaining the moving system against the fixed plate (61) wherein the inert gas input duct (77) leads to the spring system.

16. Installation according to claim 13, wherein the control head device (2) comprises at least one spring system (84) maintaining the moving system against the fixed plate (60) wherein it comprises:

A ferrule (85) concentric with the moving plate (61), the upper part of which is integral with the fixed plate (60) and the lower part of which stops close to the upper part of the said spring system (80), said ferrule (85) being provided with an inert gas supply duct (89);

A metal protection plate (90), integral with metal bracket (69) at a distance from and below said metal bracket (69) and provided with at least one opening (91);

And, a second inert gas supply duct (92) integral with metal bracket (69) and leading into the space enclosed by said protection plate and the moving system.

17. Installation, according to claim 13, wherein the control head device (2) comprises at least one spring system (80) for maintaining the moving system against the fixed plate (60) further comprising A ferrule (95) concentric with the moving plate (61), the upper part of which is integral with the fixed plate (60) and the lower part of which stops close to the upper part of the said spring system (80);

A first inert gas supply duct (101) passing through the metal bracket (69) and ending flush with the gap between said metal bracket (69) and the moving plate (61);

A metal protection plate (98) integral with the metal bracket (69) at a distance from and below said metal bracket (69) and provided with at least one opening (99) and, A second inert gas supply duct (100) integral with the metal bracket (69) and leading to the space enclosed by said protection plate and moving system.

* * * * *